US012709458B2

(12) United States Patent
Eisold

(10) Patent No.: US 12,709,458 B2
(45) Date of Patent: Aug. 18, 2026

(54) HIGH-CAPACITY INTERMODAL TRANSPORT PLATFORM

(71) Applicant: CAKEBOXX TECHNOLOGIES, LLC, McLean, VA (US)

(72) Inventor: Daine Edward Eisold, McLean, VA (US)

(73) Assignee: CAKEBOXX TECHNOLOGIES, LLC, McLean, VA (US)

( * ) Notice: Subject to any disclaimer, the term of this patent is extended or adjusted under 35 U.S.C. 154(b) by 0 days.

(21) Appl. No.: 18/876,000

(22) PCT Filed: Jun. 27, 2023

(86) PCT No.: PCT/US2023/026324
§ 371 (c)(1),
(2) Date: Dec. 17, 2024

(87) PCT Pub. No.: WO2024/006261
PCT Pub. Date: Jan. 4, 2024

(65) Prior Publication Data

US 2025/0382124 A1 Dec. 18, 2025

Related U.S. Application Data

(60) Provisional application No. 63/355,815, filed on Jun. 27, 2022.

(51) Int. Cl.
*B65D 88/12* (2006.01)

(52) U.S. Cl.
CPC ..... *B65D 88/129* (2013.01)

(58) Field of Classification Search
CPC ..... B65D 88/129; B65D 90/0033; B65D 2519/00024; B65D 88/121;
(Continued)

(56) References Cited

U.S. PATENT DOCUMENTS 5,810,156 A 9/1998 Lam
8,608,415 B2 12/2013 Crane et al.
(Continued)

FOREIGN PATENT DOCUMENTS

EP 1312565 A1 5/2003

OTHER PUBLICATIONS

International Search Report and Written Opinion for PCT Patent App. No. PCT/US2023/026324 (Dec. 1, 2023).
(Continued)

*Primary Examiner* — Shawn M Braden
(74) *Attorney, Agent, or Firm* — Cermak & McGowan LLP; Malcolm K. McGowan

(57) ABSTRACT

Described herein is a high-capacity intermodal transport platform designed to meet the requirements for intermodal transport of very heavy weight, high density cargo by sea, road, rail and air transportation systems while minimizing the need to remove or reconfigure the cargo during multi-modal and intermodal transport. The platform may be loaded with its cargo at an off-site location such a factory or a work site then easily loaded directly onto an ocean vessel deck, rail car and trailer for transport to destination. The platform may be loaded before it is placed on the transportation vehicle or may be loaded after it is placed on the transportation vehicle. Once loaded and secured to the transportation platform the cargo can be safely transported from origin to destination, and moved from one type of transportation to another, such as from truck to rail to ocean vessel with no further requirement to handle the cargo or reconfigure the way it is secured to the platform.

15 Claims, 4 Drawing Sheets

(58) Field of Classification Search
CPC ..... B65D 2519/00273; B65D 2519/00288; B65D 2519/00343; B65D 88/022
See application file for complete search history.

(56) References Cited

U.S. PATENT DOCUMENTS

| | | | | |
|---|---|---|---|---|
| 9,308,922 | B2 * | 4/2016 | Sain | B61D 3/20 |
| 10,518,823 | B1 | 12/2019 | Childress et al. | |
| 2004/0028495 | A1 * | 2/2004 | Tomkins | B65D 88/121 410/46 |
| 2007/0237611 | A1 | 10/2007 | Grams | |
| 2009/0279976 | A1 * | 11/2009 | Sain | B65D 88/129 410/46 |
| 2010/0140277 | A1 * | 6/2010 | Clive-Smith | E04C 3/10 29/446 |
| 2017/0073111 | A1 * | 3/2017 | McKay | B65D 90/18 |

OTHER PUBLICATIONS

International Preliminary Report on Patentability for PCT Patent App. No. PCT/US2023/026324 (Jan. 9, 2025).

* cited by examiner

HIGH-CAPACITY INTERMODAL TRANSPORT PLATFORM

The HIGH-CAPACITY INTERMODAL TRANSPORT PLATFORM is designed to meet the requirements for intermodal transport of very heavy weight, high density cargo by sea, road, rail and air transportation systems while minimizing the need to remove or reconfigure the cargo during multimodal and intermodal transport. The platform may be loaded with its cargo at an off-site location such a factory or a work site then easily loaded directly onto an ocean vessel deck, rail car and trailer for transport to destination. The platform may be loaded before it is placed on the transportation vehicle or may be loaded after it is placed on the transportation vehicle. Once loaded and secured to the transportation platform the cargo can be safely transported from origin to destination, and moved from one type of transportation to another, such as from truck to rail to ocean vessel with no further requirement to handle the cargo or reconfigure the way it is secured to the platform.

DETAILED DESCRIPTION

Figure 1:
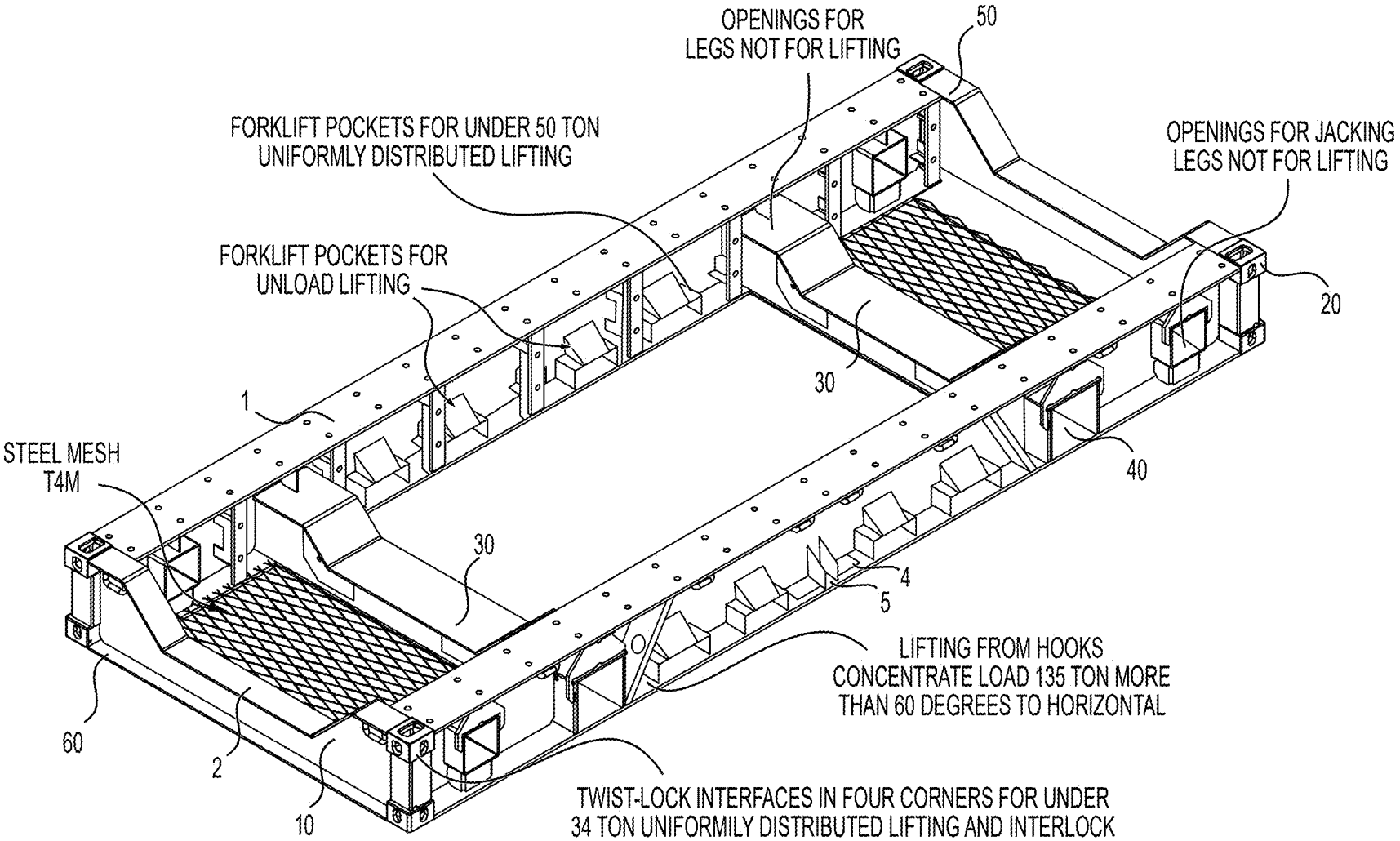
FIG. 1 is a perspective view of a 135 ton platform.
Figure 2:
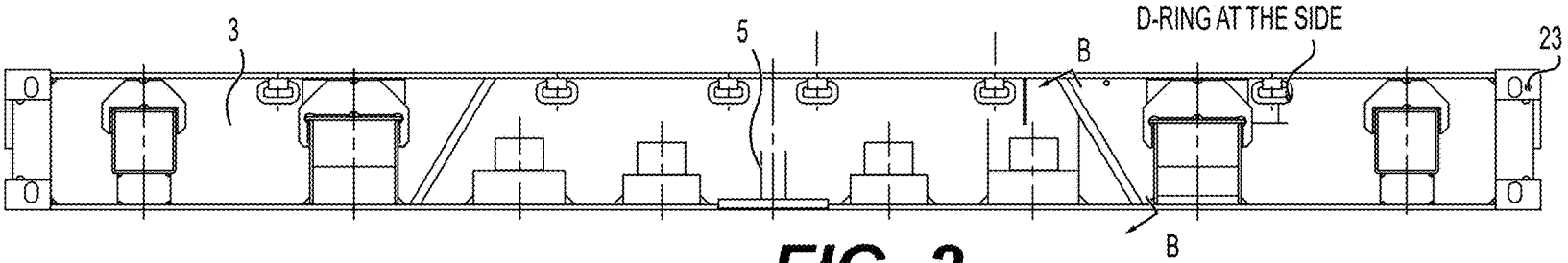
FIG. 2 is a top view of the platform.
Figure 3:
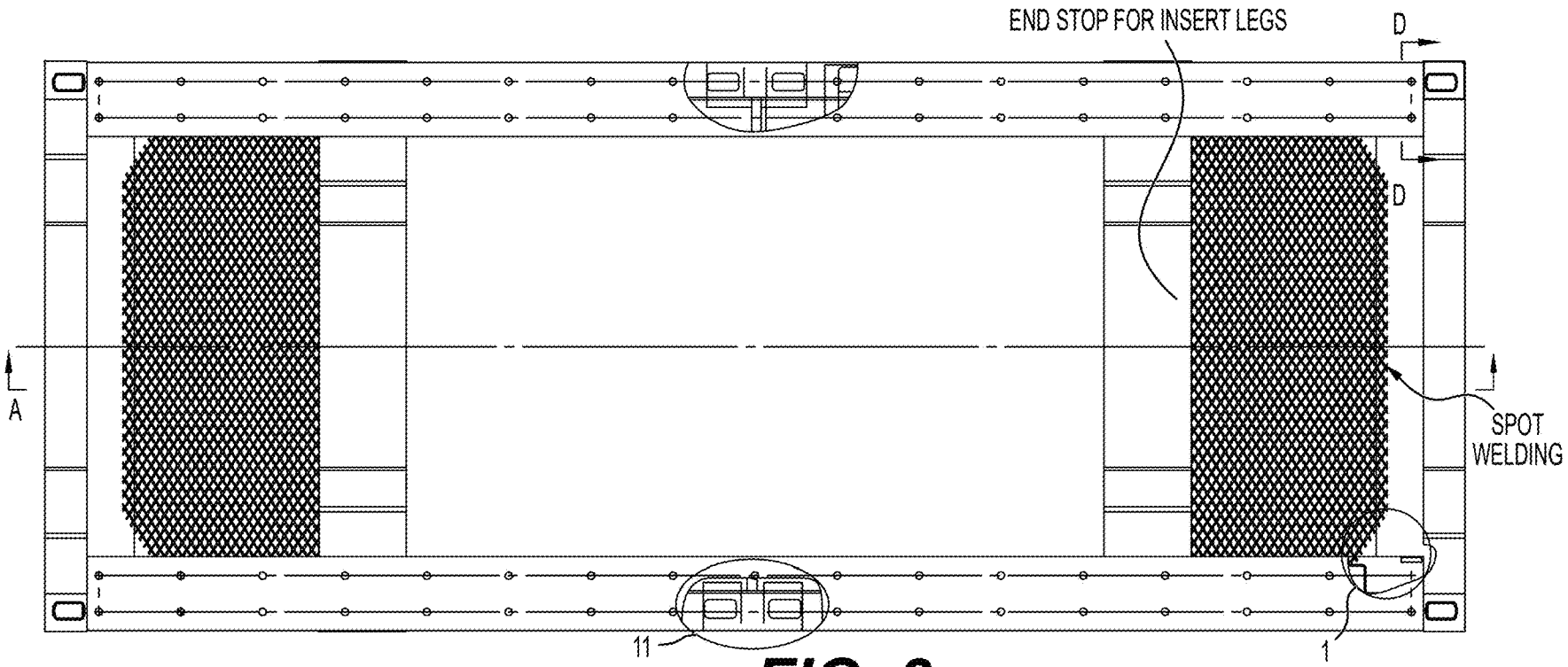
FIG. 3 is an internal side view of the platform.
Figure 4:
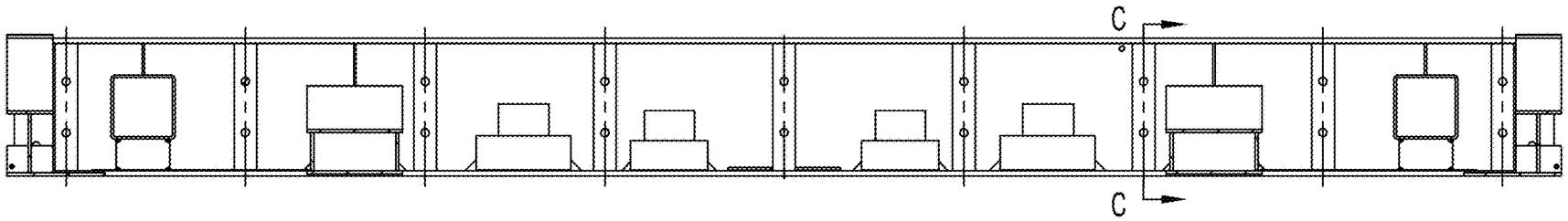
FIG. 4 is a side view of the platform.
Figure 6:
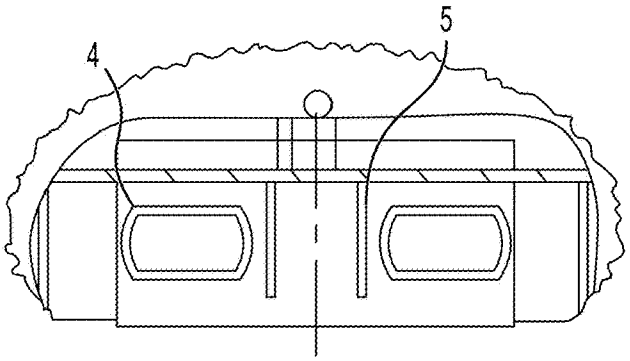
FIG. 6 is a detail of the reinforcement plate and bottom flange at centers of the sides' lower flanges.
Figure 5:
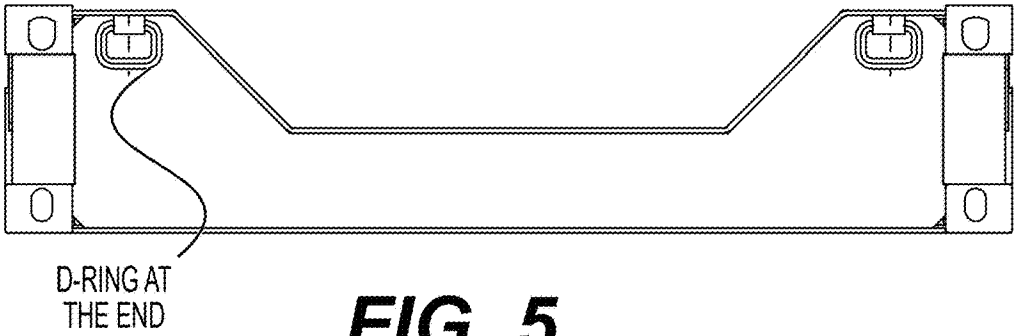
FIG. 5 is an end view of the platform.
Figure 7:
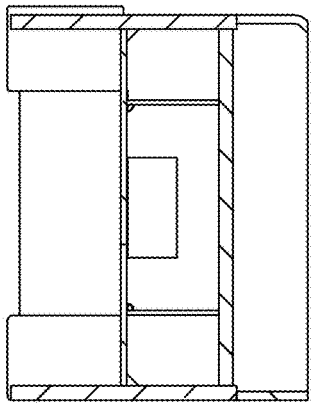
FIG. 7 is a cross-section of a side rail
Figure 8:
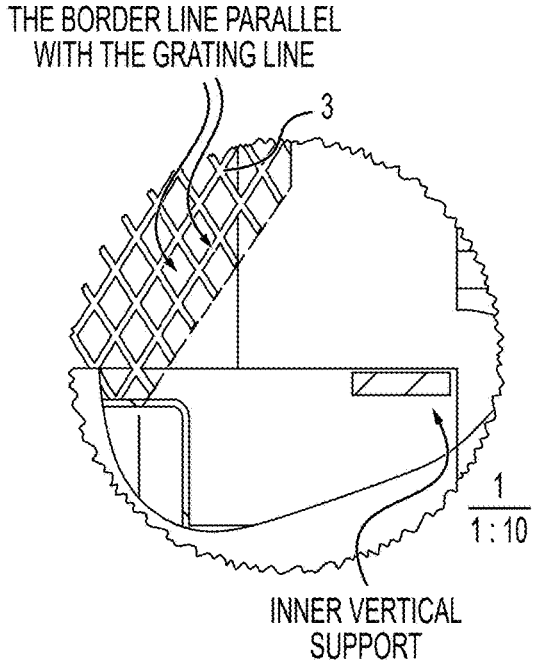
FIG. 8 is a detail of the circled area 1 in FIG. 3.
Figure 9:
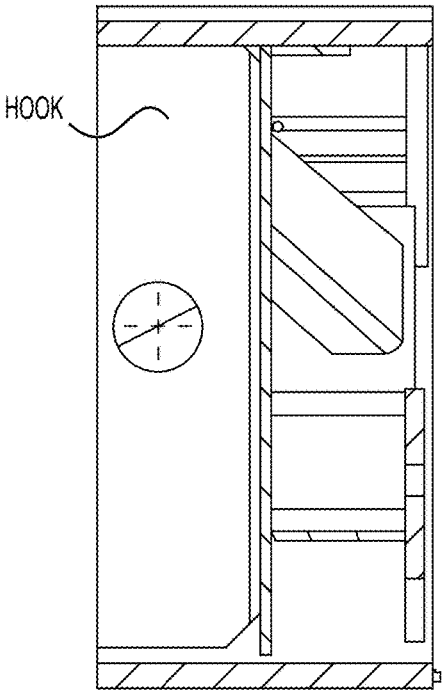
FIG. 9 is a detailed view of the structure at B-B in FIG. 2.
Figure 10:
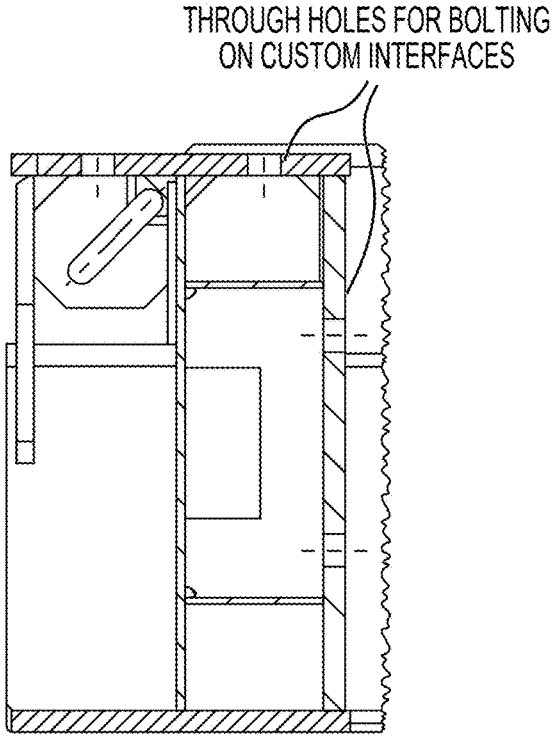
FIG. 10 is a cross-section of a side rail showing through-holes for bolting on custom interfaces

Upon review of the description and embodiments of the present invention, those skilled in the art will understand that modifications and equivalent substitutions may be performed in carrying out the invention without departing from the essence of the invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. Thus, the invention is not meant to be limiting by the embodiments described explicitly above, and is limited only by the claims which follow. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

To provide for multiple cargo types, size and weight the platform is configured with multiple tie down points, threaded and through bolt locations, hooks, fork lift slots, D-rings, corner and top shipping container style castings to allow maximum flexibility and strength for securing all shapes and weight cargos up to its maximum capacity.

The platform is constructed using standardized ISO 1161 style corner castings and typical ISO 1496/668/3874 intermodal shipping container dimensions and handling requirements to enable it to fit and be compatible with into existing shipping container based transportation systems.

Empty platforms can be handled individually as normal flat racks/platform containers. Empty, unloaded platforms can be bundled vertically using twist-lock style inter-box connectors (IBCs) and can be shipped and stored in the bundled configuration.

Caution should be used that due to its super heavy weight, a laden flatrack is not allowed to put on top of any other container when it is shipped by container vessel. On chassis the new container is suitable for road transportation, including but not limited to flat bed or skeletal chassis, secured at the four bottom corner fittings. On flat bed chassis for laden platform, should be secured at eight bottom corner fittings and supported on side rails. On rail cars for railroad transportation, the new container is secured at four bottom corner fittings. On rail cars for laden platform, the container is secured at eight bottom corner fittings and supported on side rails.

The platform is capable of being handled without any permanent deformation that will render it unsuitable for use or any other abnormality.

1. Lifting, full or empty, at the top corner fittings vertically by means of spreaders fitted with hooks, shackles or twist locks.
2. Lifting, full or empty, at the bottom corner fittings using slings with appropriate terminal fittings at slings angle of forty-five degrees to horizontal.
3. Lifting, full or empty, at the hooks using slings with appropriate terminal fittings at slings angle of forty-five degrees to horizontal.
4. Lifting, full or empty, from loaded forklift pockets.
5. Lifting, empty only, from unloaded forklift pockets.

The platform is constructed in accordance with the applicable standards and requirements set forth by the International Convention for Safe Containers (CSC). The platforms are built generally in accordance with but is varied according to agreed design criteria.

Lifting hooks lift a concentrated load on two evenly distributed areas when lifting from hooks at 45 degrees to horizontal.

All steelwork is built up by means of automatic and semi-automatic $CO_2$ gas arc welding (MAG welding). The internal bend radius of the pressed section of the steel is not less than 1.5 times the thickness of the material being pressed. The platform-based container is constructed simply with a base with ISO corner fittings [20], no walls or roof. Cast steel corner fittings comply with ISO-1161 standard and are weldable. In addition to fillings at corners, there are four additional bottom corner fittings at the center.

The platform frame has two side rails, two cross beams, two end sills, two pieces of steel meshes, lashing rings, and lifting hooks. There are many through holes and mounting features arranged on the surface, inside and outside of the side rails for mounting bolts and fixtures. Each bottom side rail is an "I" beam fabricated with high strength steel. There are several rectangle openings in the side rail web. Four in the middle are used as forklift pocket mouths. Two at the end are special designed for jack legs. The remaining two openings align with the cross beams which allow insert beams to go through to hold this platform at a certain height that the jacks lift it to.

Two cross beams connect the side rails. Each is a welded rectangle tube with a big U-shaped notch in the top center [30]. The cross beams are hollow and open at both ends. The ends match the openings in the side rail and form through tunnels [40] that the insert beams pass through. The end sills [10] are welded "I" beams with U-shaped notches at the top centers with top flanges [50] and bottom flanges [60].

There are two pieces of steel meshes provided to the areas between cross beams and end sills. These meshes are flush with the bottom flanges of the side rails.

There are six lashing rings at each side rail and four lashing rings are also provided to the end sill near the corner fittings [20]. The safety workload of these lashings is 5000 kg.

There are four specially designed sling lifting hooks that allows the platform to be lifted with slings. The lifting hooks are welded to the side rail adjacent to the cross-beam openings.

Once the welding work is done, there will be a process to remove all the slag and spatters, grinding or needle hammers will be used during this process. Then the contaminated area will be cleaned and degreased before pickling. The purpose of the pickling process is to completely remove the rust or mill scale and some other attachment on the surface. Finally, the unit is hot dip zinc galvanized to support extended outdoor use in harsh climates.

What is claimed is:

1. A high-capacity intermodal transport platform, comprising two side rails and two end sills connected with corner fittings to form a rectangular shape;

two cross beams connecting the side rails;

two pieces of steel mesh, each disposed within the rectangular shape between the side rails, one end sill, and one cross beam;

one or more lashing rings disposed on the side rails and configured to enable cargo to be secured to the platform;

lifting hooks disposed on the side rails and configured to enable the platform to be lifted with slings.

2. The platform of claim 1, further comprising one or more through holes disposed in the side rails.

3. The platform of claim 1, wherein each bottom side rail is an "I" beam fabricated with high strength steel.

4. The platform of claim 1, further comprising one or more pairs of rectangular openings in the side rail and configured to be used as forklift pocket mouths.

5. The platform of claim 1, further comprising one or more pairs of rectangular openings disposed at the ends of the side rails and/or in the end sills and configured for insertion of jack legs.

6. The platform of claim 5, further comprising one or more pairs of rectangular openings in the side rail which are aligned with the cross beams and which allow insert beams to go through to hold this platform at a certain height that the jacks lift it to.

7. The platform of claim 1, wherein the cross beams are welded rectangle tubes with a U-shaped notch in the top center.

8. The platform of claim 7, wherein the cross beams are hollow and open at both ends.

9. The platform of claim 8, wherein the cross beams have ends which match openings in the side rail and which form through tunnels.

10. The platform of claim 9, further comprising insert beams which pass through the through tunnels in the cross beams.

11. The platform of claim 1, wherein the end sills are welded "I" beams with U-shaped notches at the top centers with top flanges and bottom flanges.

12. The platform of claim 11, wherein the two pieces of steel mesh are flush with the bottom flanges of the side rails.

13. The platform of claim 1, comprising six lashing rings disposed on each side rail and two lashing rings disposed on each end sill near the corner castings.

14. The platform of claim 13, wherein the safety workload of these lashing rings is 5000 kg.

15. The platform of claim 14, wherein the lifting hooks are welded to the side rail adjacent to the cross-beam openings.

* * * * *